United States Patent [19]

Kuzin et al.

[11] 4,293,238

[45] Oct. 6, 1981

[54] DITCHLESS DRAINLAYER

[76] Inventors: Eduard N. Kuzin, ulitsa III Internatsionala, 74, kv. 199; Vladimir F. Korelin, Belgradskaya ulitsa, 20, kv. 123; Mikhail L. Fainzilber, ulitsa Budapeshtskaya, 17, korpus 5, kv. 62; Jury P. Egorov, Moskovsky prospekt, 205, kv. 64; Igor V. Erofeenko, Belgradskaya ulitsa, 36, korpus 2, kv. 17; Nikolai V. Karev, Moskovsky prospekt, 138, kv. 159; Jury S. Kozlov, ulitsa Dimitrova, 10, korpus 1, kv. 160; Viktor B. Kudish, ulitsa partizana Germana, 26, kv. 44; Valery K. Kolbasov, Basseinaya ulitsa, 82, korpus 4, kv. 84; Meri I. Bobchenok, prospekt Kosmonavtov, 13, kv. 40, all of Leningrad, U.S.S.R.

[21] Appl. No.: 953,450

[22] Filed: Oct. 23, 1978

[51] Int. Cl.[3] ..... E02F 5/10; F16L 1/02

[52] U.S. Cl. ..... 405/175; 37/193; 172/665; 172/699; 405/181

[58] Field of Search ..... 405/160, 174, 175, 180, 405/181, 183; 37/98, 193; 172/196, 197, 199, 200, 387, 665, 699, 700, 738, 764

[56] References Cited

U.S. PATENT DOCUMENTS 1,886,510 11/1932 Murphy ..... 405/181
3,032,903 5/1962 Ede ..... 37/193
3,171,500 3/1965 Dils ..... 172/700
3,429,134 2/1969 Coffey ..... 405/181 X

FOREIGN PATENT DOCUMENTS 2413853 11/1974 Fed. Rep. of Germany ..... 37/193

*Primary Examiner*—David H. Corbin
*Attorney, Agent, or Firm*—Lackenbach, Lilling & Siegel

[57] ABSTRACT

A ditchless drainlayer comprising a frame mounting a cutter-type working element for laying drainpipes. It is provided with a hydraulic cylinder for changing its angular position and a transmitter of its angular position with an amplifier-converter. Also, a device for controlling the height of the working element made as a support connected to said working element, swivels around the horizontal transverse axis and is provided with a cylinder for turning said support. The swivelling support is connected by its turning cylinder and by an additional amplifier-converter with a transmitter of the height of the working element installed on said element. The support is shaped as blades diverging in both directions from the working element, and said blades are rigidly attached to the connecting link which is articulated to the working element by two rods arranged one above the other, whose extensions converge in front of the machine as it goes, while the transmitter of the angular position of the working element is connected by its own amplifier-converter with the hydraulic cylinder intended to change the angular position of the working element.

8 Claims, 8 Drawing Figures

DITCHLESS DRAINLAYER

BACKGROUND OF THE INVENTION

The present invention relates to earth-moving machines, mainly to machines for laying horizontal drainpipes. In particular, the present invention relates to machines for laying drainpipes by the ditchless method.

The ditchless drainlayers of the present invention can be employed predominantly for constructing drainage systems in drainage and irrigation zones. They also prove useful for laying flexible pipelines or cables into the ground, particularly when it is required to ensure either a predetermined depth or gradient, or both.

It is common knowledge that drainpipes can be laid by means of drainlayers made as a chain ditch excavator working in conjunction with the drainlaying equipment. The active working element of such a drainlayer digs a more or less narrow ditch; the drainpipe is laid on the bottom of said ditch and the latter is then backfilled. Such a method of drainlaying inevitably calls for excavating and moving considerable masses of soil which causes relatively low drainlaying speeds and a low output, even with considerable powerful prime movers. Besides, this method of laying disturbs the integrity of the fertile layer of soil because clay, sand and other infertile materials are lifted to the surface and remain thereon.

These disadvantages have led to the advent of the ditchless method of drainlaying which finds an ever-growing application in the world's practice of land-reclamation and irrigation.

The essence of this method consists in that a passive working element made as a narrow pointed plow or cutter coupled to a sufficiently powerful prime mover penetrates into the ground to the required depth and cuts a narrow slit in the ground which is continuously filled with a drainpipe in the course of movement of the prime mover with the working element. The slit formed in the ground closes directly behind the cutter. This rules out the vertical movement of the soil almost completely, does not call for backfilling, does not interfere with the structure of the fertile layer of the soil and significantly increases the drainlaying speed several times.

These indisputable advantages as well as the manufacture of more and more powerful prime movers have resulted in the widespread employment of the machines for laying drains, cables, flexible pipelines, etc., by the ditchless method. The provision of such machines raises a number of problems caused by the specific features of this method of laying.

The most specific requirement for the drainage line consists in the accurate maintenance both of its depth at each point of the line and of the total preset gradient. If in the ditch-digging method these requirements can be checked (by instruments and even visually) and the impermissible errors can be timely corrected, the ditchless laying requires the provision of a system (preferably automatic) of controlling the height of the working element which would ensure the requisite accuracy of laying depth and gradient since no corrections or alterations are possible in ditchless laying of pipes.

In the course of drainlaying the prime mover, the working element is subjected to adverse effects, such as irregularities of the soil traversed by the prime mover, variations in the force of resistance to the movement of the cutter-type working element due to variations in the properties of the soil, unexpected obstacles, etc., also due to changes in the angular position of the working element.

The control elements and their operating systems are adapted to counter these adverse effects so as to minimize their influence on the laying accuracy. This problem involves, for one, speedy operation of the control system, i.e. prompt execution of the commands eliminating the effect of the encountered obstacles, preferably without delay or with a minimum delay.

Hence, the ditchless drainlayer must be coupled to a prime mover and controlled in such a manner that its working element or, more specifically, the cutting edge of the latter, would move along a required trajectory, forming the bottom of the slit to receive the drainpipe. At the same time it is necessary to retain a constant angular orientation of the working element.

Known in the prior art are machines of this type wherein the working element is mounted on a prime mover and, in the course of its positional control, rests wholly on the prime mover alone. Such a mounting of the working element hinders considerably the control of its angular position and height. The control, as has already been stated above, is intended to rule out the influence of chance changes in the position of the prime mover on the position of the working element. In this case the control system is excessively loaded, and the requirements for its high operational speed and protection against obstacles can be met only by making it highly complicated and, as a consequence, more expensive, less reliable and difficult to handle.

Therefore, the layout wherein the working element rests on the prime mover alone is used only in the machines which are not intended to ensure accurate maintenance of the depth and gradient, for example in rippers, stump pullers, cable layers, etc.

More profitable and promising are the ditchless drainlayers articulated to the prime mover and resting during the positional control of their working element not only on the prime mover but also on the ground, usually in the rear end of the working element.

Known in the prior art is a drainlayer wherein the cutter-type working element is articulated by a frame and a hydraulic cylinder with a prime mover while the height of the working element is controlled by an element in the form of an adjustable front edge of the working element. This adjustable element is connected with a hydraulic cylinder which, in turn, is controlled by the transmitter of the angular position of the working element via an amplifier-converter.

Such a drainlayer has only one control circuit and is vulnerable to the hindrances resulting from the irregularities of the ground surface traversed by the prime mover. The vertical motions of the prime mover disturb the angular position of the working element and restoring of this position by the angular position control system is not equivalent to maintaining the required digging depth at each particular point. In addition, the shifting of the working element to a new depth caused by the change in its angular position would be rather slow and takes place on a considerably long path which means that the system does not feature the required operational speed. This disadvantage is attributable to the presence of the adjustable element in the form of an adjustable front edge which, changing its angular position in the process of control, exerts no direct influence on the height of the working element, but only produces forces which turn it in the ground. Moreover, when the working element is inclined either directly or due to the turning of the front edge, this changes the ground cutting angle and thus disturbs the optimum working conditions of the working element, changes the cutting resistance and introduces new disturbances into the motion of the prime mover. Furthermore, in the process of control the working element may turn counterclockwise through such an angle at which the back angle disappears (the back angle is the angle between the rear edge of the cutter and the bottom of the slit); in this case the foot and the heel of the cutter-type working element will damage and distort the profile of the slit bottom which is unacceptable for drainlaying.

In other known drainlayers, the cutter-type working element rests on the bottom of the slit through a runner or shoe movably connected to the lower rear part of the cutter. The runner slides over the bottom of the slit being connected with the working element by a hydraulic cylinder and functions as a support for controlling the height of the working element. This support is independent of the prime mover which means that it receives the changes in its angle and height in motion. The use of the supporting runner ensures the required speed of action because the height of the cutter element is changed directly, without any intermediate elements which are responsible for the delay.

However, the use of the supporting runner brings about two new disadvantages. Firstly, resting on the slit bottom, the runner distorts it, especially so in case of loose soils, and thus diminishes the accuracy of laying the drainpipes. Secondly, being a one-sided support, the runner creates asymmetry of the "up-and-down" control of the working element. On the "down" command the runner may break away from the supporting surface and rise above it. When the working element penetrates into the ground the runner is inoperative and this penetration must take place under the weight of the working element and under the forces acting on the front edge of the cutter and other factors which are of an extremely irregular nature. An attempt to take these factors into account complicates considerably the layout of the control system and its optimum functioning.

In another type of prior art drainlayers, the cutter-type working element connected rigidly or movably to the frame is provided with carrying blades which can swivel relative to the working element, stick out on both sides from the cutter and cut into the slit walls during operation.

These blades are free from the disadvantages of the runner described above, since they constitute a two-sided support; however, being rotatably secured to the cutter with the turning axis located near the center of pressure (the fulcrum of the resultant force) they function as an integrating link and do not, therefore, feature the requisite speed of action which, as stated above, is a serious disadvantage of the system for controlling the position of the working element of the ditchless drainlayer.

Moreover, the blades of the known design prevent the cutter from being lifted when the prime mover is stopped which is extremely awkward in emergency situations or when the process of laying is completed close to an obstacle, such as a wall or the like.

Finally, the prior art devices prevent the possibility of regulating the dynamic characteristics of the system by changing the distance between the pivot of the control elements (e.g. blades) and the fulcrum of the resultant of the forces acting on the swivelling support. An increase in this distance could bring the properties of the swivelling blades close to those of the runner in respect of the speed of action while the adjustment of this distance is highly desirable for adapting the drainlayer to operation in various soils.

SUMMARY OF THE INVENTION

The main object of the invention resides in providing a new ditchless drainlayer ensuring a high accuracy of laying a drainpipe both with respect to its depth and longitudinal gradient.

Another object resides in providing a ditchless drainlayer which ensures a high drainpipe laying accuracy regardless of the contour of the terrain at a high travelling speed of the machine.

Still another object of the invention resides in providing a ditchless drainlayer adapted for work in loose soils without distorting the bottom of the ready slit.

A further object of the invention resides in providing a drainlayer which ensures a high accuracy of laying a drainpipe at a varying resistance to the cutter-type working element caused by changing characteristics of the soil, by chance obstacles, etc. which alter the angular position of the working element.

A still further object of the invention resides in providing a ditchless drainlayer provided with new working equipment incorporating an automatic control system which ensures the laying of a drainpipe with a high accuracy and speed.

One more object of the invention resides in providing a ditchless drainlayer of a simple design and reliable in operation with an automatic control system which consists of easily available standard components.

Moreover, an object of the invention resides in providing a ditchless drainlayer whose new working equipment is adapted for adjusting the speed at which the height of the cutter-type working element is changed to suit the working conditions.

And finally, an object of the present invention resides in providing a ditchless drainlayer whose working equipment can be raised easily from the ground without the necessity for moving the prime mover.

These and other objects of the invention are achieved by providing a ditchless drainlayer comprising a frame with a drainlaying working element secured to said frame and provided with a hydraulic cylinder for changing its angular position and an angular-position transmitter with an amplifier-converter. In addition, a device for controlling the height of the working element in the form of a support is connected to said working element and capable of being rotated around a transverse horizontal axis by a hydraulic cylinder. The swiveling support is connected by its turning hydraulic cylinder and an additional amplifier-converter with a transmitter is installed on the working element and indicates its position in height. The support being made as blades diverging in both directions from the working element, rigidly connected to a connecting link which is articulated to the working element by two rods arranged one above the other, whose extensions converge in the direction of movement of the machine while the transmitter of the angular position of the working element is connected by its amplifier-converter with the hydraulic cylinder intended to change the angular position of the working element.

To enable the cutter-type working element to be lifted when the drainlayer is stationary, the connecting link is provided with a swivelling sector having a controllable stop, and that the blades are rigidly secured on said sector.

Moreover, for regulating the distance between the fulcrum of the blades and the fulcrum of the resultant force with the purpose of adapting the drainlayer for operation under various soil conditions, it is possible to install a slide between the swivelling support and its turning cylinder at one side and the converging rods at the other. The slide is intended to change the convergence angle of the rods and is articulated to the rear end of the upper rod. A guide of said slide, articulated to the rear end of the lower rod is secured to the connecting link of the swivelling support while the displacement of the slide is ensured by an additional power cylinder.

The slide guide can be made either rectilinear or arched with the center of arc curvature located in the hinge of the front end of the upper rod. The last solution rules out the necessity for additional turning of the blades in the course of regulating the distance between the blade fulcrum and the fulcrum of the resultant force.

The essence of the present invention lies in the following.

The ditchless drainlayer comprises a cutter-type working element connected by a frame to the prime mover and provided with two automatic control circuits for controlling, respectively, the height and the angular position of the working element. In the first one of these circuits, the support for regulating the height of the working element is constituted by blades sticking out on both sides of the cutter-type working element and connected to the latter by two rods arranged one above the other. These articulated rods converge in front of the machine (as it goes) forming a four-bar mechanism whose upper and lower bars are constituted by these rods while the sides are constituted by the cutter-type working element and the connecting link to which the blades are rigidly connected. The point where the extensions of these rods intersect each other is the instantaneous center of velocities of the blades when the latter move relative to the cutter-type working element. This point serves as a kind of a hinge around which the blades turn. Such a layout ensures a considerable distance between the blade fulcrum and the center of pressure, i.e. the point of application of the controlling lifting force acting on the cutter. The larger this distance, the higher will be the operating speed of the control system. However, the blades perform not only the plane-parallel motion but also turn somewhat in the process of control. In the equilibrium position they are set at a certain angle of attack causing a vertical component which counters the tendency of the cutter towards penetration into the ground under the effect of its weight and the shape of the cutter point on which arises a downward directed component of the ground reaction which improves substantially the conditions of control.

The height transmitter of this circuit may be of any known design and is not the subject of the present invention. The required height and gradient throughout the length of the drainage line can be set by a tracing cable, laser beam, sighting lines of an optical instrument, etc. The type and construction of the transmitter depend on whichever of these means is selected.

The circuit for angular stabilization of the working element includes an inclination transmitter of any type (pendulum, liquid, etc.) while changes in the angular position of the working element are made, according to the invention, by a hydraulic cylinder installed between the prime mover and the frame or between the frame and the working element if the latter two are connected by an articulated joint. The constancy of the angular position ensures a corresponding constancy of the cutting angle, guarantees the existence of the back angle, thus eliminating the effect of changes in the height of the prime mover upon the angular position of the working element.

The simultaneous action of both above-mentioned circuits, i.e. stabilization of the working element with respect to angle and height weakens substantially the effect of the disturbing factors which tend to distort the trajectory of the working element. This ensures actual independence of the laying accuracy and speed on the surface irregularities under the prime mover and on the chance forces applied to the working element, thereby ensuring the laying of drainpipes with a requisite high accuracy.

In the course of laying it may become necessary to raise the working element out of the drain slit when the prime mover is standing still. This necessity may arise, for example, when encountering an unsurpassable obstacle, (a large boulder, etc.), during operation in cramped conditions, when the drainage line ends close to an artificial structure. The blades dug into the slit walls oppose such a raising.

Therefore, the blades can be secured rigidly on a rotatable sector which is articulated to the connecting link. The operator can release the sector at will and the latter will turn through 90° approximately together with the blades when the working element is raised from the slit. In such a case the blades will offer a minimum resistance to the lifting of the cutter.

An optimum distance between the blade fulcrum and the fulcrum of the resultant of the forces applied to the blades depends on the nature of the ground on which the drainlayer operates. It is practicable that the drainlayer should be provided with a device for adjusting the position of the point where the rod extensions intersect each other, said rods connecting the cutter-type working element with the connecting link and with the blades rigidly mounted on the latter. This point serves as the center around which said blades turn. The rear end of the upper rod is articulated to the slide while the latter is moved by the power cylinder along the guide which is installed on the connecting link. The movement of the slide along the guide changes the position of the upper rod and, as a consequence, the location of the point of intersection of the extensions of both rods, thus optimizing the distance between this point and the point of application of the force acting on the blades. If the guide is rectilinear, this adjustment involves an undue turning of the connecting link and blades. To avoid this turning, the guide is arc-shaped with the center thereof located in the hinged joint of the front end of the upper rod.

It should be pointed out that said objects and advantages of the present invention are achieved by conventional technical means and do not call for working out new units, mechanisms and assemblies which have not been manufactured heretofore by the industry. This applies both to the automatic control devices and to the mechanical elements. These factors ensure good processability and low cost of the ditchless drainlayer according to the invention.

BRIEF DESCRIPTION OF THE DRAWINGS

These and other objects and advantages of the present invention will become apparent from a description of an embodiment of a ditchless drainlayer that follows, with reference to the accompanying drawings, in which.

DESCRIPTION OF THE PREFERRED EMBODIMENTS

Figure 1A:
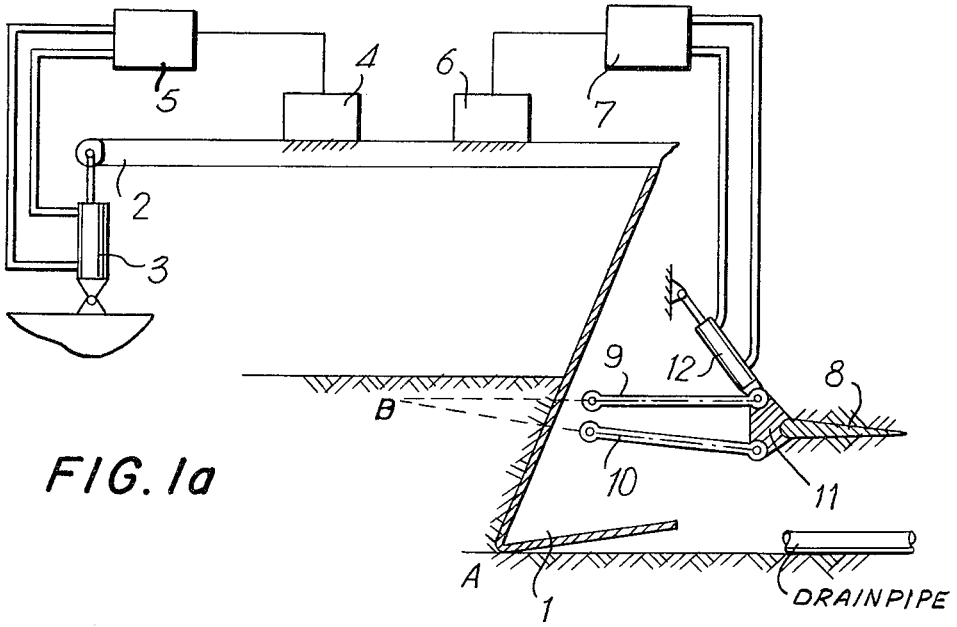
FIGS. 1*a* and 1*b* are representations of the ditchless drainlayer according to the invention.
Figure 1B:
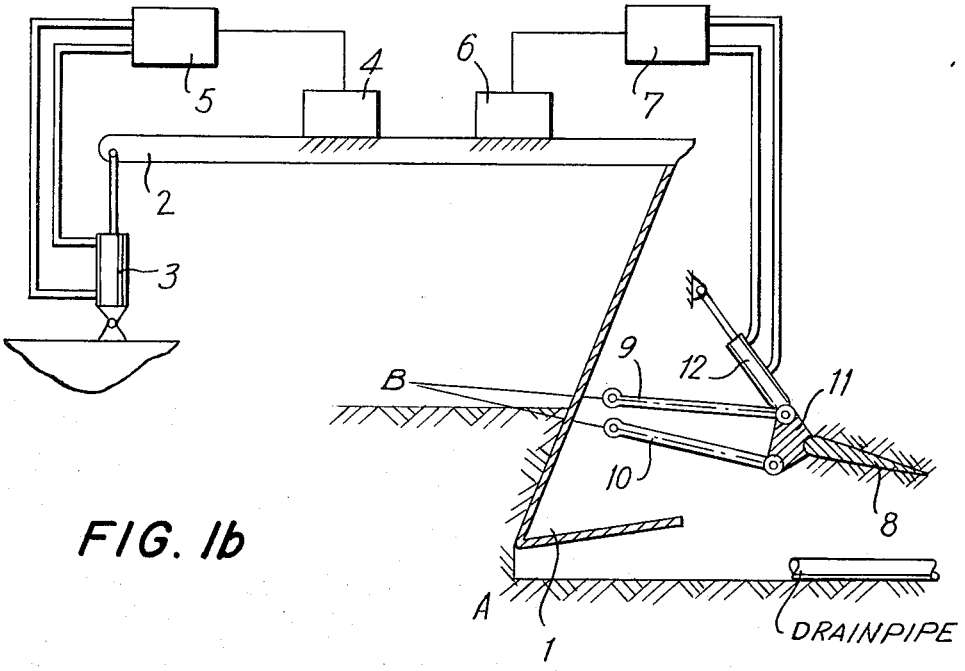

The ditchless drainlayer as shown in FIGS. 1*a* and 1*b* consists of a cuttertype working element or cutter 1 which is connected rigidly to a frame 2 whose front end is articulated to the rod of a hydraulic cylinder 3 intended for turning the working element, said cylinder being connected to the prime mover (not shown) and of two working element control systems, viz., a system of angular stabilization and a system for controlling the height of the working element.

The system of angular stabilization of the working element comprises a transmitter 4 of the angular position of the working element installed on the frame 2, an amplifier-converter 5 and the already mentioned hydraulic cylinder 3. The angular position transmitter 4 may be of any type (e.g. pendulum liquid, etc.) and is not the subject of the present invention.

Figure 7:
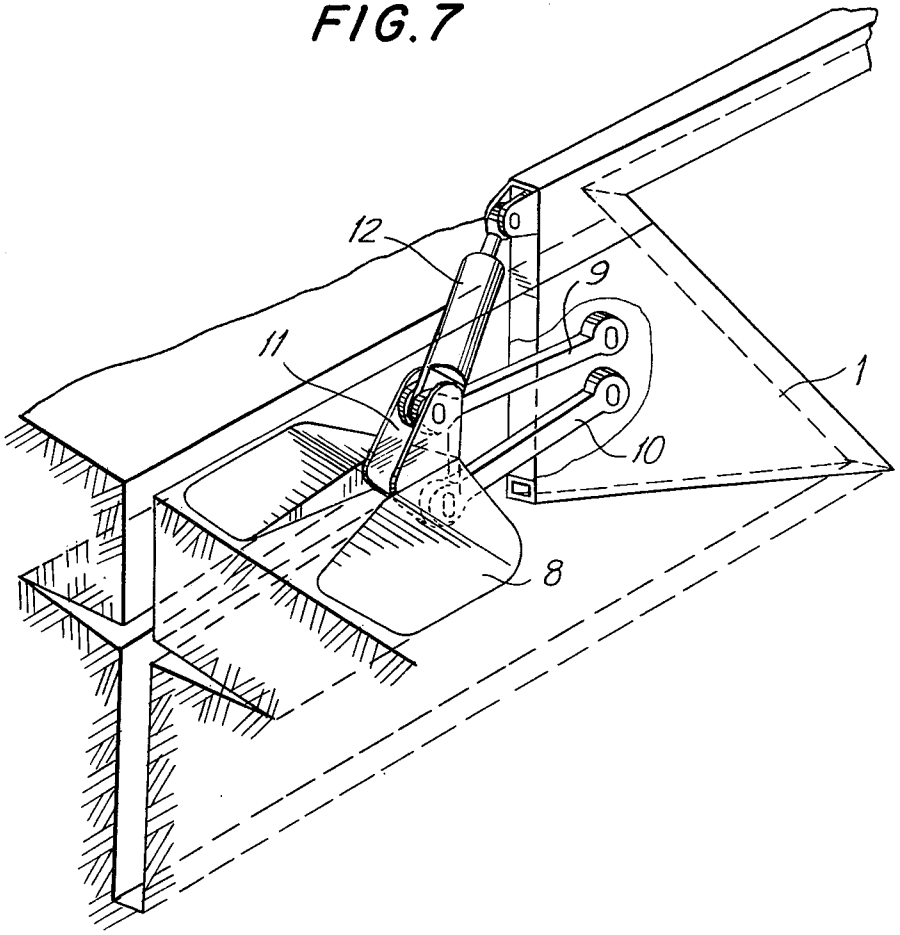
FIG. 7 is a perspective view of the working element of the ditchless drainlayer.

The system controlling the height of the working element comprises a height transmitter 6 installed on the frame 2 rigidly connected to the working element, an amplifier-converter 7, a swivelling support made as blades 8 which are connected to the cutter 1 by two rods, the upper 9 and lower 10 whose front ends are articulated to the cutter 1 while the rear ones are articulated to a connecting link 11 with blades 8 rigidly attached thereto. Installed between the blades 8 or the connecting link 11 and the cutter 1 is a hydraulic cylinder 12 of the swivelling support. As best shown in FIG. 7, the working element is provided with two blades 8 which can swivel relative to the working element and they stick out on both sides from the cutter 1 and cut into the slit rolls during operation of the apparatus.

The height transmitter 6 may be of any type suitable for the type of the drainage line requiring specific depths and gradients during laying of drainpipes. This can be either tracing wire, laser beam, optical axis of a sighting device, etc. The transmitter also should be of a corresponding type whose design is not stipulated nor limited by the present invention.

As can be seen in FIGS. 1*a* and 1*b* through 6, the upper 9 and lower 10 rods are installed in such a manner that their extensions intersect in point B located in front as the machine goes. Thus, the rods 9 and 10, the body of the cutter 1 and the connecting link 11 form a four-bar mechanism with nonparallel upper and lower sides.

Figure 2:
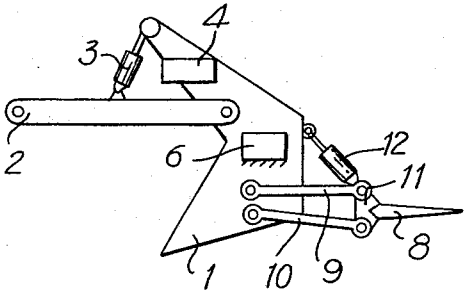
FIG. 2 is a version of the ditchless drainlayer wherein the frame is articulated to the cutter-type working element.

In the embodiment of the device shown in FIG. 2, the frame 2 is articulated to the cutter-type working element 1 at one side and to the prime mover at the other while the hydraulic cylinder 3 for turning the working element is installed between the frame 2 and the cutter 1. In this embodiment the transmitters 4 and 6 are mounted directly on the working element.

In other respects the device comprises similar parts and units both regarding their function and location.

Figure 3:
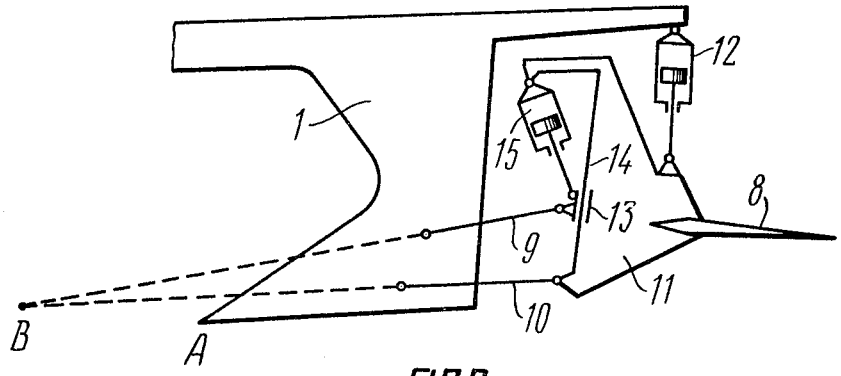
FIG. 3 is a diagram of connecting the swivelling support to the cutter-type working element with a provision for adjusting the position of the instantaneous center of velocities.

The version of connecting the blade with the working element wherein provision is made for changing the position of the point B of intersection of the rods 9 and 10 is shown in FIG. 3. In this version the rear end of the upper rod 9 is articulated to the slide 13 which changes the angle of convergence of the rods 9 and 10 and the connecting link 11 mounts the guide 14 of the slide 13, said guide being articulated to the rear end of the lower rod 10. Installed between the slide 13 and the guide 14 is an additional power cylinder 15 for moving said slide 13 over the guide 14. In the version of the device shown in FIG. 3 the guide 14 is rectilinear.

One more version of the device (FIG. 4) is fully identical with that illustrated in FIG. 3 except for the fact that the guide 16 is curvilinear, bent along an arc of a circumference with the center in the hinge of the front end of the upper rod 9.

Figure 5:
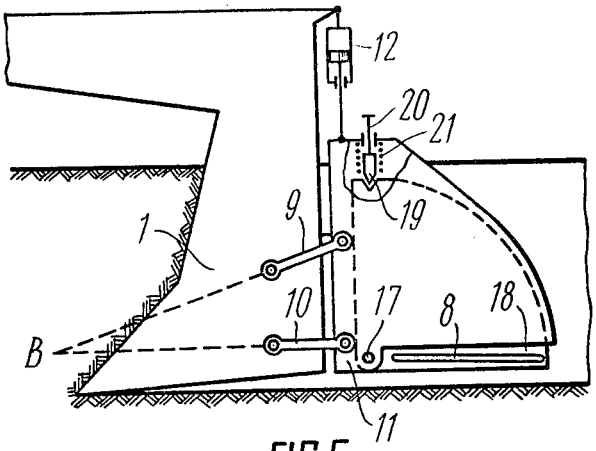
FIG. 5 shows a device for raising the working element with the stationary drainlayer (working position)
Figure 6:
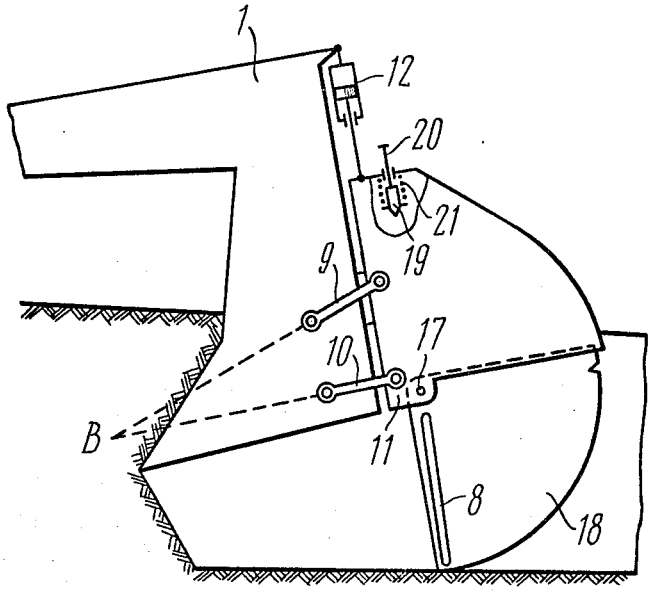
FIG. 6 is the diagram shown in FIG. 5 with the cutter being raised from the slit.

The ditchless drainlayer according to the invention can be fitted with a device which raises the working element from the ditch without moving the machine forward or back. As shown in FIGS. 5 and 6, the connecting link 11 is provided with a sector 18 installed on a horizontal transverse joint 17 and the blade 8 controlling the height of the working element is rigidly secured to said sector 18. The sector 18 is secured in the body by a stop 19 with a control rod 20 and a spring 21.

The ditchless drainlayer described above operates as follows.

The drainlayer digs into the ground to the required initial depth in a hole or trench dug in advance and starts its progressive movement, laying a drainpipe on the bottom of the trench. The transmitter 6 of the angular position of the working element continuously sends signals about any deviations of the angular position of the working element from the required direction. The amplifier-converter 5 transforms these signals into commands entering the hydraulic cylinder 3 which turns the working element. The latter is turned either together with the frame relative to the prime mover (FIGS. 1*a* and 1*b* ) or relative to the frame (FIG. 2). Simultaneously, the height transmitter 6 continuously measures the deviations of the height of the working element, or more accurately, the height of its cutting edge A, or of the depth of the trench, from the required value. This deviation is measured by the transmitter 6 with relation to a datum line which is set by one of the known methods: tracing wire, laser beam, sighting line of an optical instrument, etc.

After being amplified and converted in the amplifier-converter 7, the signals of this transmitter 6 act in the form of actuating commands on the hydraulic cylinder 12 which turns the elements controlling the height of the working element. The cylinder 12 turns the connecting link 11 and the blades 8 which are connected rigidly to said link and control the height of the cutter.

The simultaneous operation of both above-mentioned transmitters, i.e. stabilization of the working element with respect to the angular position and height, weakens considerably the effect of the disturbing factors which tend to distort the trajectory of the working element. This ensures actual independence of the laying accuracy and speed from the irregularities of the ground surface traversed by the prime mover and from the chance forces acting on the working element. The high operating speed of the control system is achieved due to the fact that the connecting link 11 and the blades 8 are connected with the cutter 1 by two articulated rods 9 and 10, which form, together with the cutter 1 and the connecting link 11, a four-bar mechanism with the upper and lower sides converging the front. The point B where the extensions of these rods intersect is the instantaneous center of the speeds of the turning blade. Such an arrangement ensures a considerable distance between the center of turning of the blades, said center serving as an imaginary hinge securing them to the cutter, and the center of pressure, i.e. the point of application of the lifting controlling force acting on the cutter. The larger this distance, the higher will be the operating speed of the control system. However, the blades perform not only the plane-parallel motion but also turn somewhat in the process of control. In the equilibrium position they are set at a certain angle of attack causing a vertical component which counters the tendency of the cutter towards penetration into the ground under the effect of its weight and the shape of the cutter point on which arises a downward-directed component of the ground reaction which improves substantially the condition of control.

The position of the instantaneous center B of turning of the blades may have to be adjusted to suit the changes in the physical and mechanical properties of the ground because the operating speed of the system must vary for different kinds of soil.

Such an adjustment is ensured by the power cylinder 15 (FIG. 3) which moves the slide 13 and, jointly with it, the rear hinge of the upper rod 9 or down along the guide 14. Changes in the relative positions of the rods 9 and 10 change the angle between them and bring the instantaneous center B of blade turning either nearer or farther. In the version illustrated in FIG. 3 this will change the angular position of the blades 8 which, in this case, will be corrected by the hydraulic cylinder 12 which will turn the blades to an equilibrium position.

Figure 4:
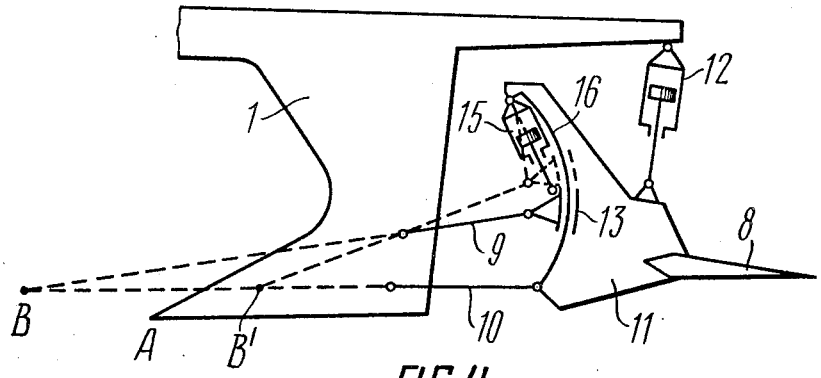
FIG. 4 is the diagram shown in FIG. 3 but with a curvilinear guide of the slide.

The mechanism shown in FIG. 4 does not call for such an additional adjustment because the action of the hydraulic cylinder 15 does not turn the blades 8 since the slide 13 moves along an arched guide 16 whose center lies in the front hinge of the upper rod 9.

In the course of drain pipe-laying it may become necessary to raise the working element from the drain slit with the prime mover immovable. This may be necessitated by, for example, an encounter with an unsurpassable obstacle (a large boulder, etc.), also during operation in cramped conditions, when the drain slit ends close to a man-made structure. The blades biting into the walls of the slit interfere with such raising.

The device illustrated in FIGS. 5, 6 makes such raising possible. For this purpose, the operator pulls back the stop 19 by the control rod 20 so that the sector 18 may turn freely in the hinge 17 relative to the connecting link 11 to the position shown in FIG. 6. Then, the blade 8 offers a minimum resistance to further extraction of the cutter from the ground.

It can be derived from the above description that the ditchless drainlayer according to the present invention is provided with a highly efficient system of coupling to the prime mover and of controlling the position of the cutter-type working element which permits laying horizontal culverts with an accuracy which meets the most exacting demands and at a laying speed which is limited only by the tractive capabilities of the prime mover in various soils on the terrain with but insignificant surface irregularities.

The device of the invention does not create any additional complications involved in the use of new, heretofore unknown, units and components.

Although the present invention has been described in some detail by way of illustration and example for purposes of clarity of understanding, it will, of course, be understood that various changes and modifications may be made in the form, details and arrangements of the parts without departing from the scope of the invention as set forth in the following claims.

What we claim is:

1. A ditchless drainlayer comprising:

a frame;

a cutter-type working element for laying drains, mounted on said frame;

a hydraulic cylinder for changing the angular position of said cutter-type working element, connected to said frame;

a transmitter of the angular position of the cutter-type working element connected to said element and to said hydraulic cylinder for changing the angular position of the cutter-type working element;

an amplifier-converter for actuating said hydraulic cylinder adapted to change the angular position on signals of said angular position transmitter;

a support swivelling around a transverse horizontal axis, adapted to change the height of said cutter-type working element, and being provided with a connecting link and a pair of blades secured thereto and extending outwardly on opposite sides of said link, said connecting link being rotatably connected with said cutter-type working element by two rods arranged one above the other whose extensions converge in front as the machine goes;

a hydraulic cylinder for turning said support, articulated between said connecting link and said cutter-type working element;

a transmitter for indicating the height of said cutter-type working element connected to said element and to said support-turning hydraulic cylinder; and another amplifier-converter for actuating said hydraulic cylinder intended to turn the support on signals from the height position transmitter.

2. A ditchless drainlayer according to claim 1 wherein said connecting link mounts a turning sector with a controllable stop, and said blades are rigidly secured to said sector.

3. A ditchless drainlayer according to claim 1, including a slide installed between the swivelling support and its turning cylinder on one side and the converging rods on the other, said slide is adapted to change the convergence angle of the rods and said slide is articulated to the rear end of the upper rod, and a guide of this slide, articulated to the rear end of the lower rod and attached to the connecting link, the slide being moved by an additional power cylinder.

4. A ditchless drainlayer according to claim 2, including a slide installed between the swivelling support and its turning cylinder on one side and the converging rods on the other, said slide is adapted to change the convergence angle of the rods and said slide is articulated to the rear end of the upper rod, and a guide of this slide, articulated to the rear end of the lower rod and attached to the connecting link, the slide being moved by an additional power cylinder.

5. A ditchless drainlayer according to claim 3 wherein the slide guide is rectilinear.

6. A ditchless drainlayer according to claim 4 wherein the slide guide is rectilinear.

7. A ditchless drainlayer according to claim 3 wherein the slide guide is arc-shaped with the center of arc curvature located in the hinge of the front end of the upper rod.

8. A ditchless drainlayer according to claim 4 wherein the slide guide is arc-shaped with the center of arc curvature located in the hinge of the front end of the upper rod.

* * * * *